US005513921A

United States Patent [19]

Alcoran

[11] Patent Number: 5,513,921

[45] Date of Patent: May 7, 1996

[54] FORMS STACKER

[75] Inventor: Gerard R. Alcoran, Buena Park, Calif.

[73] Assignee: Analog Technology Corportion, Duarte, Calif.

[21] Appl. No.: 27,343

[22] Filed: Mar. 8, 1993

[51] Int. Cl.[6] ..... B41J 15/04

[52] U.S. Cl. ..... 400/613.3; 400/613.4; 400/599.1

[58] Field of Search ..... 270/30, 39, 52.5; 493/358; 400/613.2, 613.3, 613, 613.4, 599.1, 625

[56] References Cited

U.S. PATENT DOCUMENTS

| | | | |
|---|---|---|---|
| 3,149,836 | 9/1964 | Ragozzino et al. . | |
| 3,784,188 | 1/1974 | DeLigt . | |
| 3,907,281 | 9/1975 | McKenzie . | |
| 4,508,527 | 4/1985 | Uno et al. . | |
| 4,512,561 | 4/1985 | Ury . | |
| 4,530,689 | 7/1985 | Ringer, Sr. . | |
| 4,586,703 | 5/1986 | McAnelly . | |
| 4,750,724 | 6/1988 | Herd et al. . | |
| 4,811,688 | 3/1989 | Turner . | |
| 4,842,573 | 6/1989 | Peter et al. . | |
| 5,029,828 | 7/1991 | Sato et al. . | |
| 5,058,872 | 10/1991 | Gladow . | |
| 5,110,101 | 5/1992 | Roth . | |
| 5,152,514 | 10/1992 | Meetze | 400/613.2 |
| 5,226,742 | 7/1993 | Pintar et al. | 400/613.2 |
| 5,238,316 | 8/1993 | Moore et al. | 400/613.2 |

*Primary Examiner*—John S. Hilten

*Attorney, Agent, or Firm*—Ellsworth R. Roston; Charles H. Schwartz

[57] ABSTRACT

Distressed forms or sheets folded at progressive lengths are lifted from a first platform, processed as by a printer and then stacked on a second platform on the other side of the printer from the first platform. The platform is disposed on tubular supports and is constrained on such supports to become lowered in position by the weight of the distressed forms being stacked on it. A guide extends from the printer to direct the forms downwardly into a compartment which is defined by the platform and by walls extending from the tubular supports in spaced relationship to each other. A tray is disposed on the compartment on the platform and is configured to direct the sheets downwardly so that the forward ends of the forms will be stacked properly on the platform against the forward wall. An endless belt is disposed in the compartment at the forward end of the compartment and is provided with teeth at its outer periphery. The teeth engage the forward ends of the forms as the forward ends of the forms move downwardly as by gravity in the compartment. The belt is movable in the compartment in a direction to guide the forward ends of the forms downwardly in the compartment to the platform after the forward ends of the forms become disposed in the teeth of the belt.

27 Claims, 2 Drawing Sheets

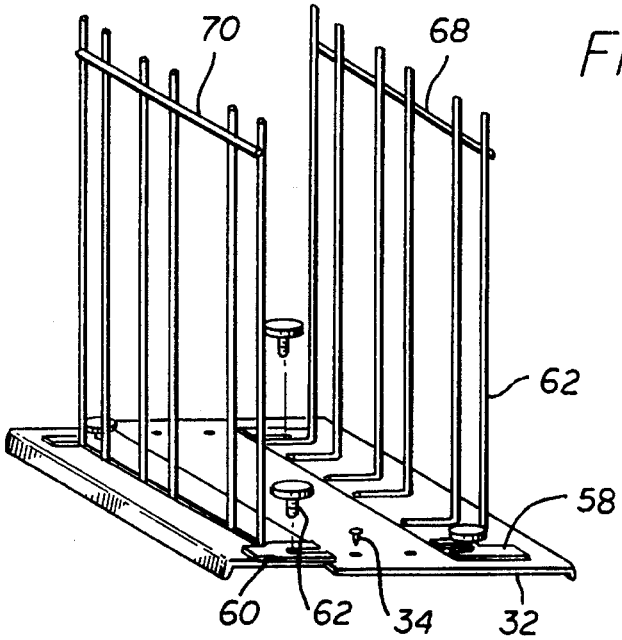
FIG. 3
FIG. 4
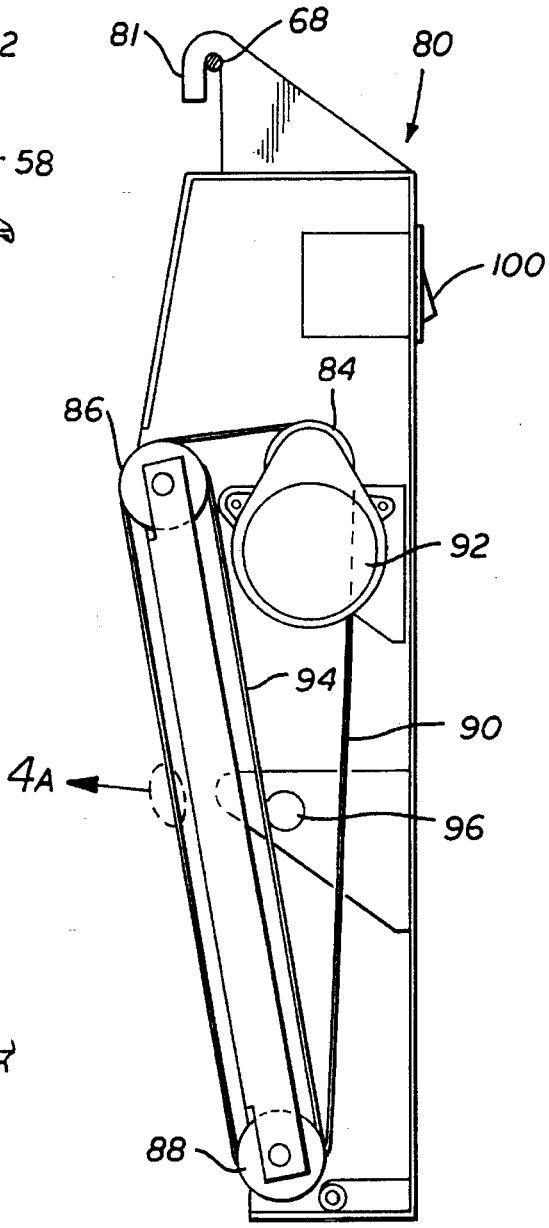
FIG. 4A
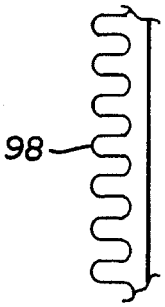
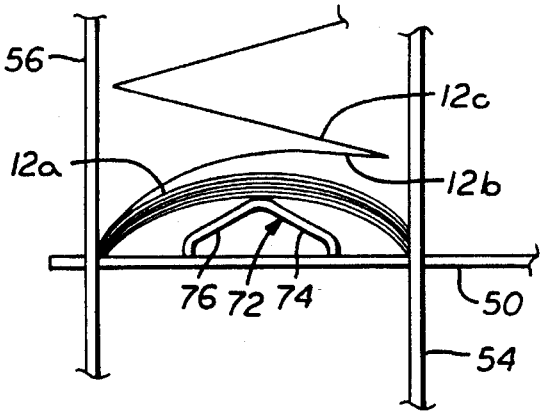
FIG. 5

FORMS STACKER

This invention relates to apparatus for stacking distressed forms on a platform. The apparatus operates to insure that the forms become stacked uniformly on the platform.

With the advent of the age of digital computers and data processing apparatus, a sequence of forms or sheets are attached to one another for the printing of individual data on the forms. The forms are distressed at their ends. In other words, the forms are creased at their opposite ends. For alternate forms, the creases are provided so that, when the forms are stacked as by gravity, the next form in the sequence will fold upon the previous form in the sequence. For alternate forms in the sequence, the next form folds upon the previous form with the crease at one end as a fulcrum. For the other forms, the next form folds upon the previous form with the crease at the other end as a fulcrum.

Generally, the distressed forms in the sequence are moved to processing apparatus such as a printer. The printer then prints on each form information general to all of the forms in the sequence or individual to that form. When the printed forms leave the printer, they become stacked in sequence upon a platform with the forms still attached to one another. This stacking occurs through gravity. Hopefully the forms become stacked, one upon another, in a substantially uniform arrangement.

Although data processing has become advanced, the stacking of distressed forms on a platform after an operation such as printing has not been as far advanced. This is true even though the conception of a layman would be that it should be easier to stack the distressed forms uniformly than to process data. In the stacking apparatus now in use, the distressed forms often do not become stacked uniformly. Furthermore, it has been particularly difficult to stack alternate forms. This has resulted from the fact that it is somehow more difficult to fold the forms at one end than at the other end. The non-uniform stacking of forms has occurred even though the apparatus stacking the forms has been relatively expensive.

A non-uniform stacking of distressed forms is undesirable. For example, it prevents or at least inhibits the forms from being automatically processed by other data processing apparatus after the operation such as printing. Even a simple operation such as cutting or separating the distressed forms at the crease lines become complicated if the forms are not stacked uniformly. It has been known for some time that a simple and reliable apparatus would be desirable for stacking distressed forms uniformly on a platform. In spite of this, such apparatus does not exist at present.

In one embodiment of the invention, distressed folded at progressive lengths are lifted from a first platform, processed as by a printer and then stacked on a second platform on the other side of the printer from the first platform. The platform is disposed on tubular supports and is constrained on such supports to become lowered in position by the weight of the distressed forms being stacked on it. Stops are provided on the tubular supports to limit the vertical movement of the platform between upper and lower positions. A guide extends from the printer to direct the forms downwardly into a compartment which is defined by the platform and by walls extending from the tubular supports in spaced relationship to each other.

A tray is disposed on the compartment on the platform and is configured to direct the forms downwardly so that the forward ends of the forms will be stacked properly on the platform against the forward wall. An endless belt is disposed in the compartment at the forward end of the compartment and is provided with teeth at its outer periphery.

The teeth engages the forward ends of the forms as the forward ends of the form move downwardly as by gravity in the compartment. The belt is movable in the compartment in a direction to guide the forward ends of the forms downwardly in the compartment to the platform after the forward ends of the sheets become disposed in the teeth of the belt.

In the drawings:

FIG. 3 is a fragmentary perspective view of other aspects of the platform assembly also shown in FIGS. 2 and 2A;

FIG. 4 is a front elevational view of an assembly included in the embodiment shown in FIG. 1 for facilitating the stacking of the forms on the platform;

FIG. 4A is an enlarged fragmentary elevational view of teeth included on a belt in the assembly shown in FIG. 4 and illustrates the portion indicated at 4A in FIG. 4;

FIG. 5 is an enlarged fragmentary front elevational view schematically illustrating the operation of a tray on the platform in facilitating the stacking of the forms on the platform.

Figure 1:
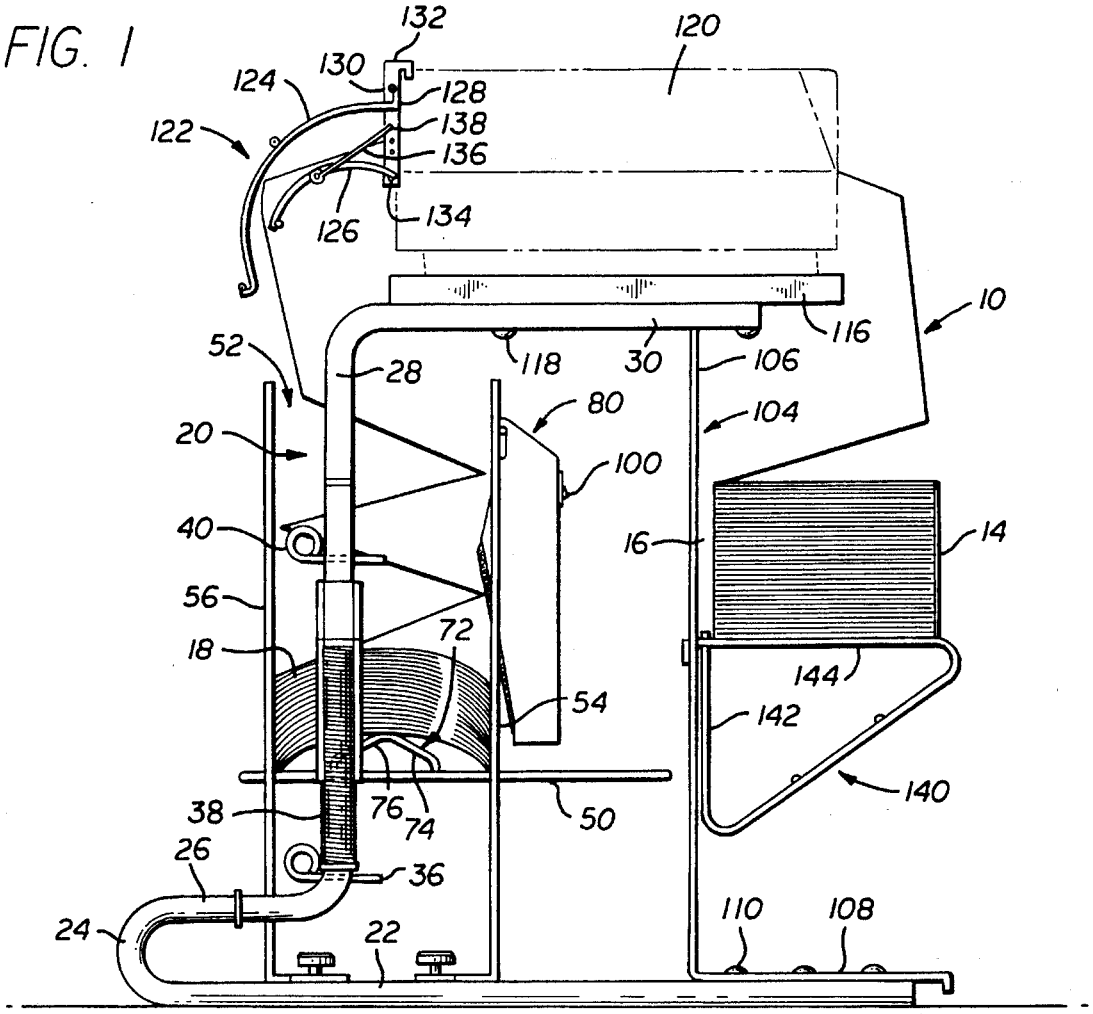
FIG. 1 is a front elevational view of a forms stacker constituting one embodiment of the invention.

In one embodiment of the invention, apparatus generally indicated at 10 is provided for stacking distressed forms or sheets 12 such as printed forms. The forms 12 are distressed because they are in a continuous sequence and are creased at opposite ends 14 and 16 to become folded upon one another and to become uniformly stacked as at 18. The crease is provided at the left end 16 of alternate forms in FIG. 1 such as a form 12*a* to have the next form such as a form 12*b* fold downwardly in a clockwise direction on the form 12*a*. The form 12*b* is creased at the right end 14 in FIG. 1 to have the subsequent form such as a form 12*c* fold downwardly in a counter clockwise direction on the form 12*b*. The form 12*c* has the same crease as the form 12*a*. Similarly, alternate forms have the same crease as the form 12*a* and the other forms have the same crease as the form 12*b*.

The apparatus 10 includes a pair of spaced tubings generally indicated at 20 and having bottom portions 22 providing a stable horizontal base. The base portions 22 are bent upwardly as at 24 at their rear ends and are then bent forwardly as at 26 from the upwardly bent portions 24. The forwardly extending portions 24 are then bent upwardly to extend in a vertical direction as at 28 for a considerable distance. The tubings 20 are then bent forwardly as at 30 to extend in a horizontal direction.

A base plate 32 (FIG. 3) is attached as by screws 34 to the bottom portions 22 of the tubings 20. Bottom stops 36 (FIG. 1) are provided on the vertical portions 28 of the tubings 20. Constrainable members such as helical springs 38 are disposed on the vertical portions 28 of the tubings 20. Stops 40 are disposed on the vertical portions 28 of the tubings 20 above the springs 38.

Figure 2:
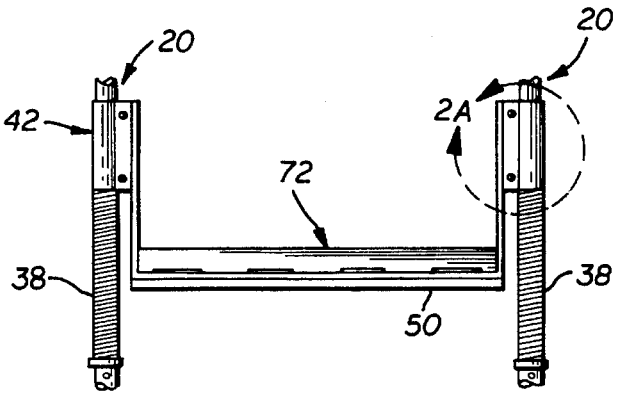
FIG. 2 is a fragmentary side elevational view of a platform assembly included in the forms stacker shown in FIG. 1.
Figure 2A:
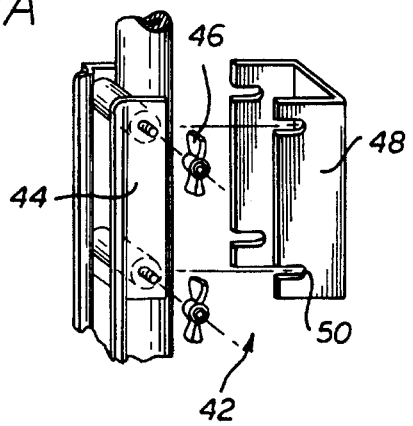
FIG. 2A is a fragmentary exploded perspective view of a portion of the platform assembly shown in FIG. 2 and illustrates the portion encircled at 2A in FIG. 2.

Brackets generally indicated at 42 (FIGS. 2 and 2A) are also disposed on the vertical portion 28 of the tubings 20 above the tray stops 40. Each of the brackets 42 includes a member 44 which is attached to the tubings as by wing nuts 46. Each of the members 44 is covered by a U-shaped plate 48 having slots 50 for receiving the wing nuts 46. Each of the plates 48 is secured to the vertical portion 28 of the associated tubing 20 by tightening the associated wing nut 46 against the member 44. A horizontal platform 50 is supported by the members 44.

The platform 50 defines a compartment, generally indicated at 52, with a forward wall 54 and a rear wall 56. The walls 54 and 56 respectively have at their bottom ends flat pads 58 and 60 (FIG. 3) which are secured to the plate 30 as by hand knobs 62. The walls 54 and 56 may be respectively formed from upwardly extending rods 64 and 66 which are unified and strengthened by horizontal bars 68 and 70 at the upper ends of the rods. The walls 54 and 56 may be preferably spaced from each other by a distance corresponding to the height of the forms 12 (the distance between the creases 14 and 16).

A tray generally indicated at 72 (FIGS. 1 and 5) is disposed on the platform 20 at a position closer to the wall 56 than the wall 54. The tray has walls extending vertically from the platform 20 at longitudinally spaced positions and with angled walls 74 and 76 extending toward each other from the vertical walls. The angled walls 74 and 76 are shaped to point, downwardly toward the forward wall 54, the forms in which the downward end becomes disposed adjacent the rear wall 56. This is illustrated schematically in FIG. 5. This facilitates the movement of the forward end of these sheets downwardly to the forward end of the platform 20 in an orderly manner so that the sheets become uniformly stacked in the compartment 52 on the platform 20 with the forward ends abutting the wall 54.

An assembly generated indicated at 80 (FIG. 4) is hooked as at 81 on the horizontal bar 68 at the forward wall 54. The assembly 80 includes a support member holding pulleys 84, 86 and 88 the centers of which are spaced from one another. A belt 90 extends around the pulleys 84, 86 and 88 for rotation by a motor 92 which drives the pulley 84. Another belt 94 extends around the pulleys 86 and 88 and rotates when the pulleys 86 and 88 are rotated by the pulley 84. The belt 94 is tightened by an adjustably positioned roller 96. The outer periphery of the belt 94 has teeth 98 which engage alternate ones of the forms 12 at the forward ends of these forms. The teeth 98 move forward ends of the sheets downwardly in the compartment 54 on a controlled basis to the platform 20 in accordance with the counter clockwise movement of the belt 94. A power switch 100 provides for an operation of the motor 92 when actuated.

A forward wall generally indicated at 104 (FIG. 1) is formed from spaced vertically disposed rods 106. The rods are provided with flat portions 108 at their bottom ends. The bottom flat portions 108 are attached to the bottom flat portions 22 of the tubing 20 as by screws 110. A table 116 is attached as by screws 118 to the horizontal portions 30 of the tubings 20.

Processing apparatus such as a printer 120 (FIG. 1) is adapted to be disposed on the table 116. The printer 120 is constructed to receive the distressed forms 12 at the front end of the printer. The printer 120 then prints information on the forms 12 either on an individual basis for each form or on a generalized basis for all of the forms. The forms then emerge from the rear end of the printer 120 into a chute generally indicated at 122. The chute 122 may be formed from a pair of spaced guide members 124 and 126. The member 124 is provided with a hooked end 128 which is retained by pins 130 on holder plates 132 at the rear end of the printer. The member 126 is also retained on pins 134 on the holder plates 132 and is braced upwardly by members 136 having one end disposed in holes 138 in the holder plates 132.

A platform generally indicated at 140 is supported by the wall 104 forwardly of the wall. The platform is provided with a looped configuration with one wall 142 in the loop disposed against the wall 104 to brace the platform. The platform 140 has a flat surface 144 which supports the distressed forms 12 in a stacked relationship before the forms are fed sequentially to the forward end of the printer 120.

As will be seen, the distressed forms 12 move from the platform 140 to the printer 120 for processing by the printer. After passing through the printer 120, the sheets 12 are directed into the chute 122 which directs the chute downwardly into the compartment 52.

As will be seen schematically in FIG. 5, the forward ends of alternate forms 12 such as the form 12*a* reach the platform 50 before the rear ends of the sheets. The rear ends of these forms become stacked uniformly on the platform 50 without any assistance from any members in the apparatus constituting the invention. For the other forms 12 such as the form 12*b* in FIG. 5, the rear ends reach the platform 50 before the forward ends. There is a tendency for these forms to deviate from any uniform stacking unless assistance is provided in stacking the forward ends of these forms.

The tray 72 provides assistance in uniformly stacking the forward ends of these forms 12 such as the form 12*b*, in which the rear ends of the forms 12 travel downwardly through the compartment 52 to reach the platform 50 before the forward ends of the sheets. The tray 72 provides this assistance by causing the weights of the forms at the forward end to tilt the forward ends of the sheets downwardly relative to the rear ends of the forms. This facilitates the downward movement of the forward end of the form 12*b* to the position directly above the forward end of the form 12*a*.

The belt 94 also provides for a controlled movement of alternate forms such as the form 12*b* in the compartment 52 to the platform 50. This results from the lodging of the forward end of the form 12*b* in one of the teeth 98 in the belt 94. The forward end of the form 12*b* is then driven by this tooth 96 downwardly in the compartment 52 to the platform 50 in accordance with the downward movement of this tooth as the belt 94 moves downwardly in the closed loop.

As the forms 12 become uniformly stacked on the platform 50, the weight of the forms causes the platform 50 to move downwardly in the compartment 52 against the constraint of the springs 38. This assures that successive ones of the forms 12 will have the same disposition vertically in the compartment 52 relative to the tray 70 and the teeth 96 on the belt 94 as the forms become stacked on the platform 50. The stops 36 and 40 limit the vertical disposition of the platform 50 between optimal upper and lower positions to assure that the tray 70 and the belt 94 will be effective in stacking the forms 12 uniformly on the platform 50.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for stacking distressed forms attached to adjacent distressed forms at their opposite ends and creased at their opposite ends to fold alternately in clockwise and counter clockwise directions, a support assembly including tubular means, platform means disposed on the tubular means in the support assembly for receiving the distressed forms and for moving downwardly in accordance with the sequential stacking of the distressed forms on the platform means, the platform means including at least one spring disposed relative to the tubular means in the support assembly to become constrained in accordance with the weight of the distressed forms on the platform means, first means for directing successive ones of the distressed forms to the platform, and second means supported by the tubular means in the support assembly and disposed in the vertical direction at a position corresponding to the ends of the distressed forms in the stacked relationship for operating upon only the second ends of the distressed forms during the movement of the distressed forms to the platform to insure the stacking of the distressed forms on the platform.

2. In a combination as recited in claim 1, each of the forms being disposed to be stacked easier at the platform at a first end than at a second end, the second means being operative in the vertical direction during the movement of the second ends of the distressed forms to the platform to ensure the stacking of the distressed forms on the platform at the second ends of the distressed forms.

3. In combination for stacking distressed forms attached to adjacent distressed forms at their opposite ends and creased at their opposite ends to fold alternately in clockwise and counter clockwise directions, a support assembly, platform means disposed on the support assembly for receiving the distressed forms and for moving downwardly in accordance with the sequential stacking of the distressed forms on the platform means, the platform means including at least one spring disposed relative to the platform means to become constrained in accordance with the weight of the distressed forms on the platform means, first means for directing successive ones of the distressed forms to the platform, and second means disposed in the vertical direction at a position corresponding to the ends of the distressed forms in the stacked relationship for operating upon one end of the distressed forms during the movement of the distressed forms to the platform to insure the stacking of the distressed forms on the platform, and a tray disposed on the platform means near a first end of the distressed forms and having the same shape regardless of the number of distressed forms on the platform to dispose the second end of the distressed forms in a direction toward the platform means as the second ends of the distressed forms move toward the platform means.

4. In a combination as set forth in claim 3, means movable in a direction toward the platform means for urging only the second ends of the distressed forms toward the platform means as the second ends of the distressed forms descend by gravity towards the platform means.

5. In combination for stacking distressed forms attached to adjacent distressed forms at their opposite ends and creased at their opposite ends to fold alternately in clockwise and counter clockwise directions, first means for providing for the movement of the forms in sequence in a substantially vertical direction, second means disposed below the first means for holding the forms in a stacked relationship, third means disposed relative to the second means for defining with the second means a compartment in which the distressed forms are stacked, the third means including a plurality of vertically disposed rods spaced horizontally from one another to define the front and rear walls of the compartment, and fourth means disposed in the compartment for operating upon the forms to insure that the forms at the one end will be stacked properly on the second means, the fourth means including means movable in a vertical direction and including teeth movable with the movable means in the vertical direction to move one end of alternate ones of the forms downwardly toward the platform.

6. In a combination as set forth in claim 5, the fourth means including a belt movable in a closed loop in the vertical direction in the compartment and having a toothed configuration in facing relationship with one end of the distressed forms for advancing such one end of the distressed forms to the second means, the fourth means being disposed on the third means externally of the compartment with a portion of the toothed configuration extending into the compartment.

7. In combination for stacking distressed forms attached to adjacent distressed forms at their opposite ends and creased at their opposite ends to fold alternately in clockwise and counter clockwise directions, first means for providing for the movement of the forms in sequence in a substantially vertical direction, second means disposed below the first means for holding the forms in a stacked relationship, third means disposed relative to the second means for defining with the second means a compartment in which the distressed forms are stacked, and fourth means disposed in the compartment for operating upon one end of the forms to insure that the forms will be stacked properly on the second means, the fourth means including means movable in a vertical direction and including teeth movable with the movable means in the vertical direction to move one end of alternate ones of the forms downwardly toward the platform, each of the forms being defined by the one end and by a second end opposite the one end, the fourth means including means disposed on the second means at a position near the second end of each of the distressed forms and having a fixed configuration regardless of the number of distressed forms on the second means for biasing the second ends of such distressed forms toward the second means as the second ends of such distressed forms descend toward the second means.

8. In combination for stacking distressed forms attached to adjacent distressed forms at their opposite ends and creased at their opposite ends to fold alternately in clockwise and counter clockwise directions, each of the distressed forms having a finite weight, tubings defining a main frame, a platform slidably disposed on the tubings for receiving the distressed forms in a stacked relationship, first means including constrainable means disposed on the tubings for providing a slidable disposition of the platform on the tubings in accordance with the finite weight of the distressed forms on the platform, a printer disposed on the tubings above the platform, second means for providing a guided movement of the distressed forms from the printer toward the platform, and third means, including a belt and teeth on the belt, supported by the tubings above the platform for facilitating the movement of one end of the distressed forms to the platform in the stacked relationship.

9. In a combination as set forth in claim 8, means for limiting the vertical movements of the platform on the tubings.

10. In combination for stacking distressed forms attached to the adjacent forms at their opposite ends and creased at their opposite ends to fold alternately in clockwise and counter clockwise directions, tubings defining a main frame, a platform slidably disposed on the tubings for receiving the distressed forms in a stacked relationship, first means disposed on the tubings for providing for a slidable disposition of the platform on the tubings in accordance with the weight of the distressed forms on the platform, second means for providing a guided movement of the distressed forms toward the platform, and third means, including a belt and teeth on the belt, disposed above the platform for facilitating the movement of one end of the distressed forms to the platform in the stacked relationship, the printer having one side and having a second side opposite the one side, holding means supported by the tubings on the opposite sides of the printer, the platform, the first means and the second means being disposed on the one side of the printer, a second platform supported by the tubings for holding the distressed forms in a stacked relationship on the second side of the printer, and a table supported by the tubings for receiving the printer, the distressed forms being movable from the second platform through the printer and the second means to the first platform.

11. In a combination as set forth in claim 10, means for limiting the vertical movements of the platform on the tubings, the third means including a tray disposed on the platform and shaped to bias only the one end of the distressed forms toward the platform as the distressed forms descend from the first means toward the platform.

12. In a combination as set forth in claim 11, the second means including a toothed belt disposed at end of the platform contiguous to the one end of the forms to receive the one end of the forms in the toothed belt, the toothed belt being movable downwardly to direct the one end of the forms to the platform.

13. In combination for stacking distressed forms attached to adjacent distressed forms at their opposite ends and creased at their opposite ends to fold alternately in clockwise and counter clockwise directions, tubular means defining a support structure, the tubular means having a first end and having a second end opposite the first end, a first platform disposed on the tubular means at the first end of the tubular means for holding the distressed forms in a stacked relationship, a second platform disposed on the tubular means at the second end of the tubular means for holding the distressed forms in a stacked relationship, first means disposed on the tubular means between the first and second platforms for receiving the distressed forms from the first platform, processing the forms and directing the processed forms to the second platform, and second means supported by the tubular means and disposed relative to the second platform for facilitating the movement of one end of the distressed forms to the second platform.

14. In a combination as set forth in claim 13, third means supported by the first means and disposed between the first means and the second platform for guiding the distressed forms toward the second platform after the processing of such distressed forms by the first means, and fourth means including constrainable means supported by the tubular means and disposed in co-operative relationship with the second platform for providing a controlled movement of the second platform downwardly on the tubular means in accordance with the sequential stacking of the distressed forms on the second platform.

15. In a combination as set forth in claim 14, the distressed forms having a second end opposite the one end, the second means including fifth means disposed on the second platform at a position near the second end of the distressed forms on the second platform and shaped to bias the one end of the distressed forms during the descent of the one end of the distressed forms to the second platform to facilitate the stacking of the one end of the distressed forms on the second platform, the fifth means constituting a tray having a fixed disposition regardless of the number of the distressed form on the second platform, the second means also including sixth means supported by the tubular means and disposed above the second platform with a disposition at one end adjacent the one end of the distressed forms and movable in a closed loop in a vertical direction at the one end of the closed loop and provided with teeth at the one end of the sixth means to hold the one end of the distressed forms and to move the one end of the distressed forms downwardly into the stacked relationship on the second platform.

16. In a combination as recited in claim 13, the distressed forms having a second end opposite the one end, the second means including third means disposed on the second platform at a position near the second end of the distressed forms on the second platform and shaped to bias the one end of the distressed forms relative to the other end of the distressed forms during the descent of the one end of the distressed forms to the second platform to facilitate the stacking of the one end of the distressed forms on the second platform, the third means constituting a tray having a fixed configuration regardless of the number of the distressed forms on the second platform.

17. In a combination as set forth in claim 13, the second means including third means supported by the tubular means and disposed above the second platform with a disposition at one end adjacent the one end of the distressed forms and movable in a closed loop in a vertical direction at the one end of the closed loop and provided with teeth at the one end of the closed loop to hold the one end of the distressed forms and to move the one end of the distressed forms downwardly into the stacked relationship on the second platform.

18. In combination for stacking distressed forms attached to adjacent distressed forms at their opposite ends and creased at their opposite ends to fold alternately in clockwise and counterclockwise directions, support means, first means for directing the forms toward the support means for the support of the forms by the support means, the forms having a finite weight, second means including constrainable means for providing for a controlled downward movement of the support means from the finite weight of the forms on the support means, third means disposed on the support means and shaped to point only the downwardly moving end of alternate ones of the forms toward the support means as the forms move downwardly toward the support means, fourth means for receiving the downwardly moving end of the alternate ones of the forms and for moving such end downwardly to the support means as such alternate ones of the forms are moving downwardly toward the support means, and the third means including a tray disposed on the support means and having a fixed configuration regardless of the number of the distressed forms on the support means and shaded to direct the second ends of the distressed forms to the support means.

19. In combination for stacking distressed forms attached to adjacent distressed forms at their opposite ends and creased at their opposite ends to fold alternately in clockwise and counterclockwise directions, support means, first means for directing the forms toward the support means for the support of the forms by the support means, the forms having a finite weight, second means including constrainable means for providing for a controlled downward movement of the support means from the finite weight of the forms on the support means, third means disposed on the support means and shaped to point only the downwardly moving end of alternate ones of the forms toward the support means as the forms move downwardly toward the support means, and fourth means for receiving the downwardly moving end of the alternate ones of the forms and for moving such end downwardly to the support means as such alternate ones of the forms are moving downwardly toward the support means, the third means including a tray disposed on the support means near an end opposite the downwardly moving end of the alternate ones of the forms and shaped to point only such downwardly moving end downwardly toward the support means as such alternate ones of the forms are moving downwardly toward the support means, fifth means defining a compartment with the support means for receiving the distressed forms in a stacked relationship, the fifth means being formed from a plurality of vertically disposed rods horizontally spaced from one another.

20. In a combination as set forth in claim 19, the fourth means including an endless movable belt with teeth for engaging only the downwardly moving end of the alternate ones of the forms and for directing such end vertically downwardly to the support means in accordance with the movement of the belt, and sixth means operatively coupled to the belt for moving the belt in the endless configuration.

21. In a combination as set forth in claim 20, the support means including a pair of spaced tubular members, the constrainable means including springs disposed on the tubular members for constraint in accordance with the finite weight of the distressed forms on the tubular member, and means disposed on the tubular members for limiting the constraint of the springs.

22. In combination for stacking distressed forms attached to adjacent forms at their opposite ends and creased at their opposite ends to fold alternately in clockwise and counterclockwise directions, support means, first means for directing the forms toward the support means for the support of the forms by the support means, second means for providing for a downward movement of the support means from the weight of the forms on the support means, third means disposed on the support means and shaped to point the downwardly moving end of each alternate form toward the support means as the form is moving downwardly toward the support means, and fourth means for receiving the downwardly moving end of alternate ones of the forms and for moving such end downwardly to the support means as such alternate ones of the forms are moving downwardly toward the support means, the support means including a pair of spaced tubular members, the constrainable means including springs disposed on the tubular members for constraint in accordance with the finite weight of the distressed forms on the tubular means, means disposed on the tubular members for limiting the constraint of the springs, the third means constituting a tray disposed on the support means near the end opposite the downwardly moving end of the alternate ones of the forms and shaped to point such downwardly moving end downwardly toward the support means as such alternate ones of the forms are moving downwardly toward the support means, the fourth means constituting an endless movable belt with teeth for engaging the downwardly moving end of the alternate ones of the forms and for directing such end vertically downwardly to the support means in accordance with the movement of the belt, fifth means defining a compartment with the support means and the tubular member, the fifth means being formed by a plurality of vertically disposed rods spaced horizontally from one another.

23. In combination for stacking distressed forms material attached to adjacent distressed forms at their opposite ends and creased at their opposite ends to fold alternately in clockwise and counterclockwise directions, support means, first means defining a compartment with the support means, second means for providing a downward movement of the distressed forms into the compartment and onto the support means, third means disposed on the support means and shaped to point the downwardly moving end of alternate ones of the forms downwardly toward the support means as such alternate ones of the forms are moving downwardly into the compartment toward the support means, the third means including a tray disposed on the support means and having a fixed shape regardless of the number of the distressed forms on the support means and shaped to point the downwardly moving end of alternate ones of the forms downwardly toward the support means as such alternate ones of the forms are moving downwardly into the compartment toward the support means, and fourth means including a belt and teeth on the belt for receiving the downwardly moving end of the alternate ones of the forms and for moving such end downwardly to the support means as such alternate ones of the forms are moving downwardly toward the support means.

24. In a combination as set forth in claim 23, tubular means, the support means being disposed on the tubular means, and the fourth means being disposed on the tubular means.

25. In combination for stacking discrete forms attached to adjacent distressed forms at their opposite ends and creased at their opposite ends to fold alternately in clockwise and counterclockwise directions, support means, first means defining a compartment with the support means, second means for providing a downward movement of the distressed forms into the compartment and onto the support means, third means disposed on the support means and shaped to point the downwardly moving end of alternate ones of the forms downwardly toward the support means as such alternate one of the forms are moving downwardly into the compartment toward the support means, and fourth means for receiving the downwardly moving end of the alternate ones of the forms and for moving such end downwardly to the support means as such alternate ones of the forms are moving downwardly toward the support means, the first means including a plurality of vertically disposed rods spaced horizontally from one another, and the fourth means being disposed on the rods externally of the compartment and extending at one end into the compartment through the space between the rods, the end extending into the compartment including a belt and teeth on the belt.

26. In combination for stacking distressed forms material attached to adjacent distressed forms at their opposite ends and creased at their opposite ends to fold alternately in clockwise and counterclockwise directions, support means, first means defining a compartment with the support means, second means for providing a downward movement of the distressed forms into the compartment and onto the support means, third means disposed on the support means and shaped to point the downwardly moving end of alternate ones of the forms downwardly toward the support means as such alternate ones of the forms are moving downwardly into the compartment toward the support means, the third means including a tray disposed on the support means and having a fixed shape regardless of the number of the distressed forms on the support means and shaped to point the downwardly moving end of alternate ones of the forms downwardly toward the support means as such alternate ones of the forms are moving downwardly into the compartment toward the support means, fourth means including a belt and teeth on the belt for receiving the downwardly moving end of the alternate ones of the forms and for moving such end downwardly to the support means as such alternate ones of the forms are moving downwardly toward the support means, tubular means, the support means being disposed on the tubular means, and the fourth means being disposed on the tubular means, each of the distressed forms having a finite weight, means associated with the support means for providing a downward movement of the support means in accordance with the finite weight of the distressed forms stacked on the support means, a table supported on the tubular means, a printer disposed on the table, and a platform supported on the tubular means externally of the compartment for holding the distressed forms and for providing for a movement of the distressed forms from the platform through the printer to the second means.

27. In combination for stacking discrete forms attached to adjacent distressed forms at their opposite ends and creased at their opposite ends to fold alternately in clockwise and counterclockwise directions, support means, first means defining a compartment with the support means, second means for providing a downward movement of the distressed forms into the compartment and onto the support means, third means disposed on the support means and shaped to point the downwardly moving end of alternate ones of the forms downwardly toward the support means as such alternate one of the forms are moving downwardly into the compartment toward the support means, and fourth means for receiving the downwardly moving end of the alternate ones of the forms and for moving such end downwardly to the support means as such alternate ones of the forms are moving downwardly toward the support means the first means including a plurality of vertically disposed rods spaced horizontally from one another, and the fourth means being disposed on the rods externally of the compartment and extending at one end into the compartment through the space between the rods, the end extending into the compartment including the teeth on the belt, the third means constituting a tray disposed on the support means near the end opposite the downwardly moving end of the alternate ones of the forms and shaped to point such downwardly moving end downwardly toward the support means as such alternate ones of the forms are moving toward the support means, the fourth means including an endless movable belt and teeth on the belt and the teeth on the belt being disposed to engage the downwardly moving end of the alternate ones of the forms and to direct only such end to the support means in accordance with the movement of the belt.

* * * * *